United States Patent [19]

McElroy et al.

[11] Patent Number: 4,467,270

[45] Date of Patent: Aug. 21, 1984

[54] AUTOMATIC DEPARTURE TEST UNIT FOR CAB SIGNAL EQUIPMENT

[75] Inventors: John M. McElroy, Monroeville; Charles E. Janney, Plum Borough, both of Pa.

[73] Assignee: American Standard Inc., Swissvale, Pa.

[21] Appl. No.: 306,020

[22] Filed: Mar. 31, 1981

[51] Int. Cl.[3] ..... G01R 31/02; B61L 21/00

[52] U.S. Cl. ..... 324/51; 246/28 F

[58] Field of Search ..... 246/28 F, 169 R; 340/825.36; 324/73 R, 51

[56] References Cited

U.S. PATENT DOCUMENTS 2,719,912 10/1955 Maenpaa ..... 246/28 F
2,738,416 3/1956 Ihrig .
3,390,256 6/1968 Clanton .
3,991,403 11/1976 Olsson .
4,053,879 10/1977 Anderson .
4,228,537 10/1980 Henckels ..... 324/73 R X
4,314,234 2/1982 Darrow ..... 246/169 R X
4,361,301 11/1982 Rush .

*Primary Examiner*—Stanley T. Krawczewicz
*Assistant Examiner*—Jose M. Solis
*Attorney, Agent, or Firm*—J. B. Sotak

[57] ABSTRACT

An automatic car carried departure test unit including an integrated circuit code oscillator for generating coded signals and an integrated circuit carrier oscillator for producing a carrier signal which is modulated by the coded signal to produce coded carrier signals. The coded carrier signals drive a current source which directly injects current signals into a pair of series aiding pick-up coils for testing the reception of coded speed command signals by the pick-up coils and the amplifier of the cab signal receiver. An integrated circuit speed oscillator produces simulated speed signals which are logically processed in sequential order to verify the operation of the overspeed functions of the automatic train protection equipment.

17 Claims, 5 Drawing Figures

CARRIER OSCILLATOR
MC14536B
CAO
CODE OSCILLATOR
MC14541
COO
ANALOG SWITCH
MC14051
MDI
LED 1
LED 2
LED 3
LED 4
A1
A3
A4
A5
R1
R2
R3
R4
R5
R6
R7
R8
R9
R10
R11
R44
R45
R46
C1
C2
+B

| | |
|---|---|
| FIG. 2 | FIG. 4 |
| FIG. 1 | FIG. 3 |

AUTOMATIC DEPARTURE TEST UNIT FOR CAB SIGNAL EQUIPMENT

FIELD OF THE INVENTION

This invention relates to a car-borne test set for testing the cab signal equipment and more particularly to an automatic departure testing unit for checking the reception of simulated coded speed command signals which are directly injected into the pickup coils and the amplifier of the cab signal receiver and also for verifying the overspeed and zero velocity functions of the automatic train protection equipment.

BACKGROUND OF THE INVENTION

In automatic train protection equipment for railway and mass and/or rapid transit operations, it is mandatory to perform a daily departure test on each locomotive or lead vehicle before releasing a train into regular revenue service. Normally, the departure test was conducted on a special section of track which was equipped with a loop of wire. The wire loop was connected to associated circuitry which was initiated from the wayside to inductively couple feigned cab signals into pickup coils mounted forward of the front axle of the lead vehicle or locomotive. An alternative method that was previously employed to perform the required departure test utilized a pair of external coils which were meticulously positioned beneath the pickup coils of the vehicle. In practice, the two inductive coils were manually disposed a predetermined distance from car carried pickup coils so that the simulated cab signals produced by the associated external electronic equipment could be sufficiently magnetically coupled to the pickup coils. It will be appreciated that both of the previous departure testing methods not only were time-consuming but also were expensive from the standpoint of required equipment and excessive man-hours. Further, the train or lead vehicle under test was unduly delayed because of the excessive amount of time necessary for setting up and conducting the daily departure test. In addition, previous departure testing apparatus did not have the capability of handling overspeed functions which enhance the quality of testing.

OBJECTS OF THE INVENTION

Accordingly, it is an object of this invention to provide a new and improved departure testing unit.

Another object of the invention is to provide a unique car departure test set which automatically tests the various signal functions of a vehicle.

A further object of this invention is to provide an automatic departure testing unit which performs the daily departure tests on cab signal equipment.

Yet another object of this invention is to provide an automatic departure testing unit which checks the proper operation of the speed command, overspeed, and zero velocity functions.

yet a further object of this invention is to provide a built-in departure testing unit which automatically tests for cab signal speed command reception as well as for overspeed and zero velocity operations.

Still another object of this invention is to provide a car carried test set for performing daily departure set on the cab signal equipment.

Still a further object of this invention is to provide an automatic departure testing unit for cab signal equipment comprising, first means for producing a plurality of coded carrier signals representing a series of speed commands, second means for producing a plurality of simulated speed signals corresponding to the series of speed commands, third means for causing the first means to produce one of the plurality of the coded carrier signals and for causing the second means to produce a corresponding one of the plurality of the simulated speed signals, fourth means for receiving the plurality of the coded carrier signals for checking the operability of a cab signal receiver, fifth means for checking the correspondence of the ones of the plurality of the coded carrier signals and the plurality of the simulated speed signals, and sixth means for verifying the functionality of overspeed operation by increasing the simulated speed signals to cause the release of an underspeed relay whereby each speed command of the series of the plurality of coded carrier signals and corresponding simulated speed is sequentially proceeded until the occurrence of a failure or until the completion of the test.

An additional object of this invention is to provide a car carried automatic departure testing unit which is economical in cost, unique in design, efficient in operation, dependable in service, durable in use, and easy to manufacture.

SUMMARY OF THE INVENTION

In the attainment of the above objects, there is provided an automatic departure testing apparatus for checking the integrity of the pickup coils and the operation of the amplifier of the cab signal receiver and/or decoding units and for verifying the overspeed and zero velocity functions of the automatic train protection equipment. The testing operation is started by depressing a push-button switch which resets a binary coded decimal counter and a bistable multivibrator provided that the zero relay is energized thereby signifying that the train is safely stopped. The output of the binary coded decimal counter is connected to the inputs of a pair of analog switches. One of the pair of analog switches interconnects a selective value of resistance to the input of an RC code oscillator. The output of the RC code oscillator is connected to the input of an RC carrier oscillator for producing modulated carrier signals. The modulated carrier signals are supplied to the input of a constant current amplifier the output of which is directly connected to the pickup coils and amplifier of the cab signal receiver. The other of the pair of analog switches interconnects a selective value of resistance to the input of an RC speed oscillator. The output of the RC speed oscillator is connected by a multistage amplifier to the input of a speed sensor and indicator relay circuit which produces one of a plurality of output speed signals. Each of the output speed signals is connected to one input of a separate one of a plurality of two-input AND gates. The outputs of the plurality of the two-input AND gates are coupled by a plurality of OR gates to one input of another two-input AND gate. A pulse generator is connected to the other input of the another two-input AND gate. The output of the another two-input AND gate is connected to the clock input of the flip-flop circuit, and an underspeed relay contact is connected to the data input of the flip-flop circuit. The output of the flip-flop circuit is connected to the input of a bilateral switch which has its outut selectively connected to the input of the R-C speed oscillator. The output of the flip-flop circuit is also connected to the clock input of the binary coded decimal counter. The output of the binary coded decimal counter is connected to the input of a binary coded decimal-to-decimal decoder which produces a given one of a plurality of output signals, and all but one of the plurality of output signals of the binary coded decimal-to-decimal decoder are connected to the other input of the separate ones of the plurality of the two-input AND gates. The one of the plurality of output signals of the binary coded decimal-to-decimal decoder is connected by a two-stage amplifier to an indicating light which is illuminated when the test is completed.

BRIEF DESCRIPTION OF THE DRAWINGS

The above objects and other attendant features and advantages of the present invention will become more readily apparent from the following detailed description when considered and reviewed in conjunction with the accompanying drawings, in which.

DETAILED DESCRIPTION OF THE INVENTION

Figure 1:
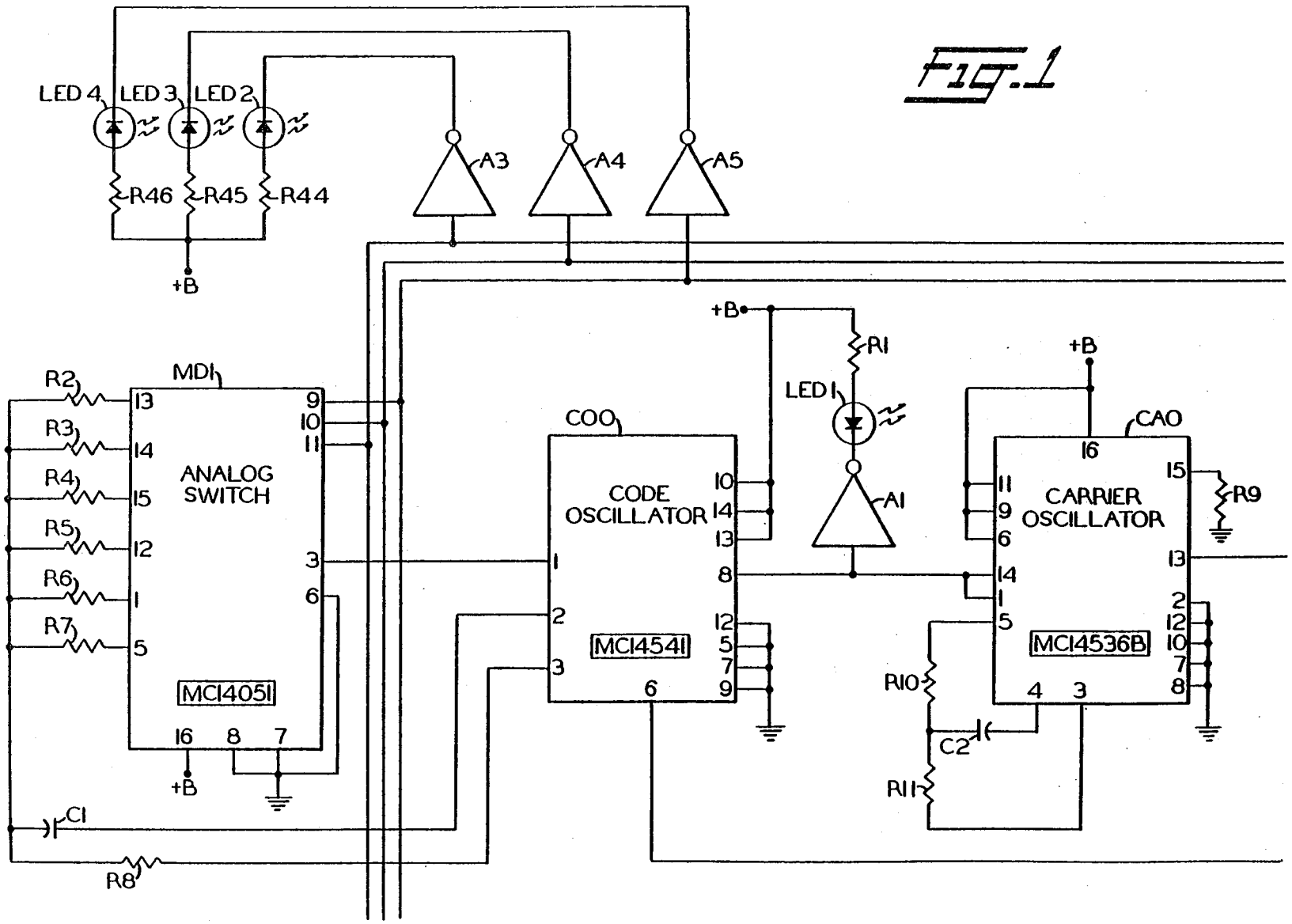
FIGS. 1, 2, 3, and 4, arranged in accordance with the chart of FIG. 5, illustrate in schematic form a circuit arrangement of the apparatus embodying this invention which provides an automatic departure test unit for cab signal equipment.

Referring now to the drawings, and in particular to FIG. 1, there is shown the circuit means for producing the coded carrier signal which represents a series of desired speed commands. As shown, a code generating or oscillating circuit COO may take the form of an integrated circuit programmable timer, such as, a low-power complementary MOS MC14541B, manufactured and sold by Motorola, Inc. The integrated circuit oscillator COO will oscillate at a coded rate or frequency determined by the R-C time constant of a selected one of a plurality of external resistance-capacitance networks, as will be described presently. That is, the frequency of oscillation is a function of the resistive value on the $R_{tc}$ terminal 1 and the capacitive value on the $C_{tc}$ terminal 2. As will be described hereinafter, a fixed resistor is connected to the $R_S$ terminal 3 of the code oscillator COO. The AUTO RESET, $V_{SS}$, $Q/\overline{Q}$ select and "A" terminals 5, 7, 9, and 12, respectively, are connected in common and, in turn, are connected to a reference point, such as, ground. The MODE, "B", and $V_{DD}$ terminals 10, 13, and 14, respectively, are connected in common and, in turn, are connected to a suitable source of operating potential, such as, a positive supply voltage +B. The various code signals are developed on output terminal 8 and are used to drive an integrated circuit amplifier A1. As shown, the output of amplifier A1 is connected to a light emitting diode LED 1 which, in turn, is connected to the positive voltage terminal +B via current limiting resistor R1. In practice, the light emitting diode LED 1 is mounted on the card edge of the printed circuit board to allow the maintainer to visually observe the flashing light which flashes at the given code rate of the oscillator COO.

As mentioned above, the frequency of oscillation of code oscillator COO is determined by the value of the resistance which is connected to terminal 1 and by the value of the capacitance which is connected to the terminal 2. In the present instance, the code oscillator COO is arranged to produce six (6) different code rates or frequencies which respresent six (6) individual speed commands for testing the subject cab signal equipment. However, it will be appreciated that a greater or less number of code rates may be generated by the oscillator COO depending upon the specific needs of the particular cab signal equipment. As shown, the $R_{tc}$ terminal 1 of the code oscillator COO is connected to a common out/in terminal 3 of an analog multiplexer/demultiplexer MD1 such as, a low-power complementary MOS MC14051, made and sold by Motorola, Inc. The analog multiplexer MD1 is a digitally controlled analog switch having switch in/put terminals 13, 14, 15, 12, 1, and 5 and having control terminals 9, 10, and 11. It will be seen that the switch terminals 13, 14, 15, 12, 1, and 5 are connected to a respective one of a plurality of timing resistors R2, R3, R4, R5, R6, and R7. In practice, the resistive values of the timing resistors vary in decending order with the resistor R2 having the highest resistance. As shown, the remote ends of resistors R2 through R7 are connected in common and, in turn, are connected to one end of timing capacitor C1 and to one end of the fixed resistor R8. The other end of capacitor C1 is connected to $C_{tc}$ terminal 2 of the integrated circuit code oscillator COO while the other end of resistor R8 is connected to $R_S$ terminal 3 of code oscillator COO. Thus, it will be appreciated that the frequency of oscillation of the code oscillator COO is determined by the R-C time constants of the resistive and capacitive values of R2-C1, R3-C1, R4-C1, R5-C1, R6-C1, or R7-C1 which produce code rates or frequencies of 5 Hz, 6.6 Hz, 8.6 Hz, 10.8 Hz, 13.6 Hz, and 16.8 Hz, respectively. As will be described hereinafter, the analog switch MD1 is controlled by binary input signals on terminals 9, 10, and 11 which selectively cause one of the resistors R2 through R7 to be connected from the switch terminal 3 of the analog switch MD1 to the timing terminal 1 of the code oscillator COO. As shown, INHIBIT terminal 6, the $V_{EE}$ terminal 7, and the $V_{SS}$ terminal 8 of the integrated circuit switch MD1 are commonly connected to ground while the $V_{DD}$ terminal 16 is connected to the positive supply voltage +B.

The carrier signal is produced by an integrated circuit programmable timer CAO, such as, an MOS MC14536B made by Motorola, Inc. As shown, the code signal from output terminal 8 of the code oscillator COO is fed to OSCILLATOR INHIBIT terminal 14 and SET terminal 1 of carrier oscillator CAO. The $V_{DD}$ terminal 16, "C" terminal 11, "A" terminals 9 and 8, and BYPASS terminal 6 of the carrier oscillator CAO, are commonly connected to the positive voltage terminal +B while the RESET terminal 2, CLOCK INHIBIT terminal 7, $V_{SS}$ terminal 8, "B" terminal 10, and "D" terminal 12 are commonly connected to ground. As shown, the MONO-IN terminal 15 is connected to ground via resistor R9. The frequency of oscillation of the carrier signal is determined by the R-C time constant of resisstor R10 and capacitor C2. It will be noted that the OUT 2 terminal 5 is connected to one end of timing resistor R10 while the OUT 1 terminal 4 is connected to one end of timing capacitor C2. The other ends of resistor R10 and capacitor C2 are connected to one end of resistor R11 which has the other end connected to the IN 1 terminal 3 of the carrier oscillator CAO. Thus, the carrier oscillator CAO is switched ON and OFF by the code signals on terminals 1 and 14 so that coded carrier signals are produced on DECODE OUTPUT terminal 13.

Figure 3:
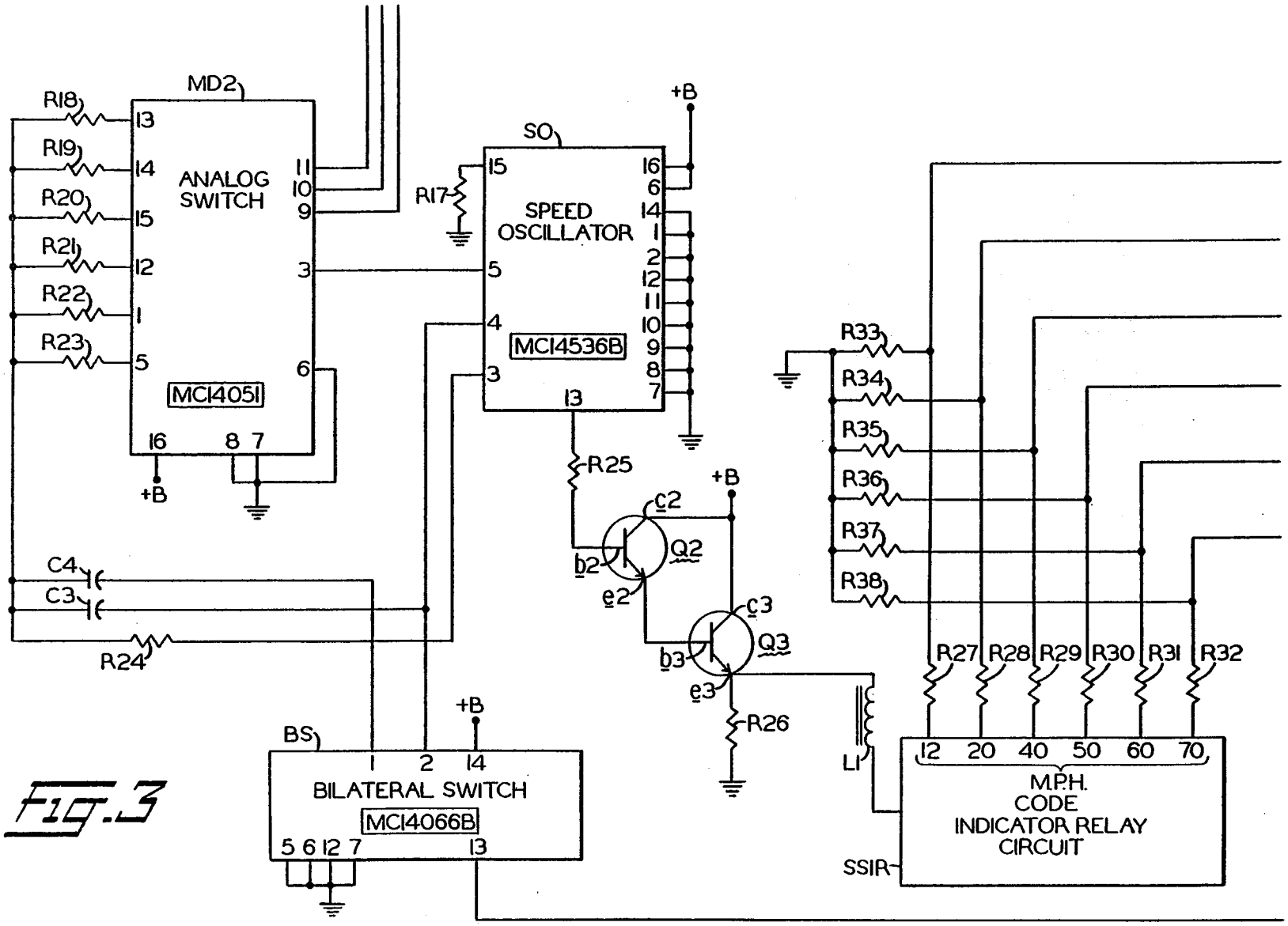

In viewing FIG. 3, it will be seen that the modulated or coded carrier signals appearing on terminal 13 are applied to the input of a constant current source CS which includes an NPN amplifying transistor Q1 having a base electrode b1, collector electrode cl, and an emitter electrode e1. A current limiting resistor R12 has one end connected to output terminal 13 of the carrier oscillator CAO and has the other end connected to the junction point formed between the voltage dividing resistors R13 and R14. The base electrode b1 is also connected to the junction point formed between resistors R13 and R14. The top end of resistor R13 is connected to the positive voltage terminal +B while the bottom end of resistor R14 is connected to ground. The emitter electrode e1 is connected to ground via resistor R15. The collector electrode c1 is connected to the input of the cab signal receiver CSR. In practice, the collector electrode c1 which exhibits a very high impedance is directly connected to one end of the pickup coil PC1 while the lower end of series adding pickup coil PC2 is at one half of the power supply voltage. The coils PC1 and PC2 are connected to the amplifier of the cab signal receiver CSR. Thus, the modulated signals are directly injected into the cab signal equipment so that there is no need for external track loop or inductive coils.

Referring now to FIG. 3, there is shown the speed simulating means for the test unit. As shown, a speed generating or oscillating circuit SO which may take the form of integrated circuit programmer timer, such as, a Motorola MOS MC14536B. It will be noted that the $V_{DD}$ terminal 6 and the MASTER RESET terminal 16 are commonly connected to the positive supply terminal +B. Like the code oscillator CAO, the integrated circuit speed oscillator SO will oscillate at a frequency determined by the R-C time constants of a selected one of a plurality of external resistance-capacitance networks. It will be noted that the MONO-IN terminal 15 of speed oscillator SO is connected to ground via resistor R17. As shown, the OSCILLATOR INHIBIT terminal 14, the SET terminal 1, the RESET terminal 2, the "D" terminal 12, the "C" terminal 11, the "B" terminal 10, the "A" terminal 9, the $V_{SS}$ terminal 8, and the CLOCK INHIBIT terminal 7 are commonly connected to ground. It will be observed that the $R_{tc}$ terminal 5 of the speed oscillator SO is directly connected to the common out/in terminal 3 of an analog multiplexer/demultiplexer MD2, such as, a Motorola MOS MC14051B. The analog multiplexer/demultiplexer MD2 includes a plurality of switch in/out terminals 13, 14, 15, 12, 1, and 2 which are controlled in accordance with the binary code of control terminals 9, 10, and 11. It will be seen that the switch terminals 13, 14, 15, 12, 1, and 2 are connected to a respective one of a plurality of timing resistors R18, R19, R20, R21, R22, and R23 which decrease in value from top to bottom. As shown, the remote ends of resistors R18 through R23 are connected in common and, in turn, are connected to one end of timing capacitor C3 and one end of resistor R24. The other end of timing capacitor C3 is connected to $C_{tc}$ terminal 4 of speed oscillator SO while the other end of resistor R24 is connected to RS terminal 3 of the speed oscillator SO. It will be seen that the resistors R18 through R23 are also connected to one end of a second timing capacitor C4, the purpose of which will be described hereinafter. Thus, the frequency of oscillation of the speed oscillator SO is determined by the R-C time constants of the selected resistive and capacitive elements. As shown, the INHIBIT terminal 6, the $V_{EE}$ terminal 7, and the $V_{SS}$ terminal 8 of the analog switch MD2 are commonly connected to ground while the $V_{DD}$ terminal 16 is connected to the positive supply voltage terminal +B. Thus, the oscillating circuit SO produces selective simulated speed signals on Decode Output terminal 13 which is connected to the input of a two-stage amplifier including NPN transistors Q2 and Q3. The input transistor Q2 includes a base electrode b2, a collector electrode c2, and an emitter electrode e2 while the output transistor Q3 includes a base electrode b3, a collector electrode c3, and an emitter electrode e3. As shown, the output terminal 13 of speed oscillator SO is connected to base electrode b2 via resistor R25. The emitter electrode e2 is directly connected to the base electrode b3 while the collector electrodes c2 and c3 are commonly connected to the positive supply terminal +B. The emitter electrode e3 is connected by resistor R26 to ground and is also connected by inductor L1 to the input of a speed sensor which is connected to the code indicator relay circuit SS1R.

Normally, the speed sensor takes the form of a magnetic reluctance transducer which produces a signal having a frequency proportional to the actual speed or velocity of the vehicle. However, the vehicular speed signals are simulated by the present test unit by direct injection into the transducer.

Figures 4, 5:
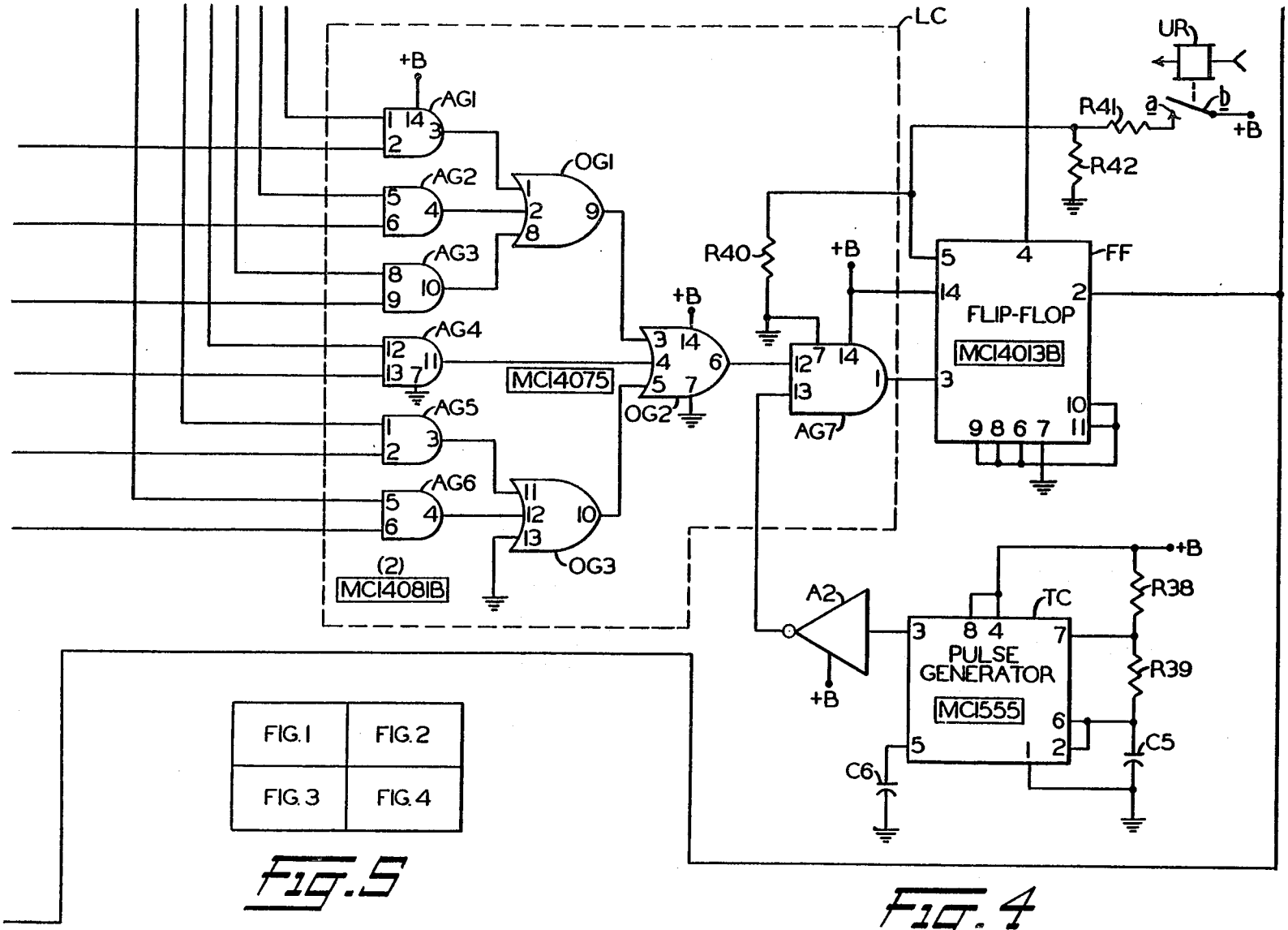
FIG. 5 comprises a chart diagram showing the manner of arranging the other drawing figures to completely illustrate a preferred embodiment of the present invention.

When a particular code relay is energized, there is simultaneously generated a nominal underspeed frequency signal by the analog switch MD2 and speed oscillator SO. This signal is injected directly into the speed sensor transducer. Thus the underspeed relay will be energized at this time. The next pulse of the pulse generator TC will increase the previous nominal underspeed frequency to a higher overspeed frequency, thus deenergizing the underspeed relay. The next pulse of the pulse generator TC then steps the counter up one to the next code rate frequency and speed frequency and the above process repeats. In the present instance, there are six (6) indicator relays each of which represents one of six (6) different speeds, for example, 12 mph, 20 mph, 40 mph, 50 mph, 60 mph, and 70 mph. In practice, the indicator relays close a respective front contact to provide a positive voltage on one of the six (6) output terminals 12, 20, 40, 50, 60, or 70. The outputs from the code rate indicator relay circuit SS1R are connected to logic network LC which includes a plurality of AND and OR gates as shown in FIG. 4. It will be seen that the logic network LC includes six (6) input AND gates AG1 through AG6 and an output AND gate AG7. The AND gates AG1, AG2, AG3, and AG4 are formed on a first MOS chip while the AND gates AG5, AG6, and AG7 are formed on a second MOS chip. Each of the chips is a Motorola MC14081B Quad 2-input AND gate which includes P and N channel enhancement mode devices constructed on a single monolithic structure. As shown, the 12 mph output terminal of the code indicator relay circuit SS1R is connected to input terminal 2 of AND gate AG1 via resistor R27 when a relay contact closure occurs while the 20 mph output terminal is connected to input terminal 6 of AND gate AG2 via resistor R28 when its relay contact closure occurs. The 40 mph output terminal is connected to input terminal 9 of AND gate AG3 via resistor R29 while the 50 mph output terminal is connected to input terminal 13 of AND gate AG4 via resistor R30. The 60 mph output terminal is connected to input terminal 2 of AND gate AG5 via resistor R31 while the 70 mph output terminal is connected to input terminal 6 of AND gate AG6 via resistor R32. It will be seen that the input terminals 2, 6, 9, 13, 2, and 6 of the AND gates AG1 through AG6 are connected to ground via respective resistors R33, R34, R35, R36, R37, and R38. The latter resistors prevent the inputs of the AND gates from floating which could cause damage to the gates. The first MOS chip is powered by having the $V_{DD}$ terminal 14 of the integrated circuit AND gate AG1 connected to the positive voltage terminal +B and by having the $V_{SS}$ terminal 7 of AND gate AG4 connected to ground. The output terminal 3 of AND gate AG1 is connected to input terminal 1 of a first three-input OR gate OG1 which forms part of a triple 3-input OR gate, such as, a Motorola MOS MC14075B, which is constructed with P and N channel enhancement mode devices in a single monolithic structure. As shown, operating power is supplied to the monolithic chip via the $V_{DD}$ terminal 14 and $V_{SS}$ terminal 7 of OR gate OG2. The output terminal 3 of AND gate AG1 is connected to the input terminal 1 of the first OR gate OG1. The output terminal 4 of AND gate AG2 is connected to input terminal 2 of OR gate OG1 while the output terminal 10 of AND gate AG3 is connected to input terminal 8 of OR gate OG1. The output terminal 11 of AND gate AG4 is connected to input terminal 4 of a second three-input OR gate OG2. The output terminal 3 of AND gate AG5 is connected to input terminal 11 of the third three-input OR gate OG3 while the output terminal 4 is connected to the input terminal 12 of OR gate OG3. The input terminal 13 of OR gate OG3 is connected to ground. The output terminal 9 of OR gate OG1 is connected to input terminal 3 of OR gate OG2 while the output terminal 10 of OR gate OG3 is connected to input terminal 5 of OR gate OG2. The output terminal 6 of OR gate OG2 is connected to input terminal 12 of AND gate AG7.

In viewing FIG. 4, it will be noted that a MOS MC1555 monolithic timing circuit TC produces clock pulses for timing purposes. In practice, the pulse generator TC is an astable oscillating circuit which has a free running frequency and duty cycle accurately controlled by a pair of external resistors R38–R39 and a capacitor C5. It will be seen that the $V_{CC}$ terminal 8 and RESET terminal 4 are commonly connected to the positive supply terminal +B. The resistors R38 and R39 and the capacitor C5 are serially connected between the positive supply terminal +B and ground. The discharge terminal 7 is connected to the junction point formed between the resistors R38 and R39 while the threshold terminal 6 and the trigger terminal 2 are commonly connected to the junction formed between resistor R39 and capacitor C5. The control voltage terminal 5 is connected to ground via capacitor C6. Thus, periodic clock or timing pulses are produced on output terminal 3 which, in turn, are applied to the input of inverting amplifier A2. The amplified clock pulses are supplied to the input terminal 13 of AND gate AG7. The second MOS chip is powered by having the $V_{DD}$ terminal 14 of AND gate AG7 connected to the positive voltage terminal +B and having the $V_{SS}$ terminal 7 connected to ground. It will be noted that the output terminal 1 of AND gate AG7 is connected to clock terminal 3 of a dual type D flip-flop FF, such as, a Motorola MOS MC14013B. The $V_{SS}$ terminal 7 as well as terminals 6, 8, 9, 10, and 11 of the monolithic flip-flop or bistable multivibrator FF are commonly connected to ground. The $V_{DD}$ terminal 14 is connected to the positive supply terminal +B. The data terminal 5 of flip-flop FF is connected to ground via resistor R40 and also is connected to the junction of a voltage divider network including resistors R41 and R42. The free end of resistor R41 is connected to the back contact a of an underspeed relay UR. The underspeed relay UR includes a movable or heel contact b which is connected to the positive supply terminal +B. The RESET terminal 4 of flip-flop FF is connected to a start circuit which will be described in detail hereinafter. The $\overline{Q}$ output terminal 2 is connected to a clock input terminal 15 of a binary coded decimal counter BCDC shown in FIG. 2 and also is connected to control terminal 13 of a bilateral switch BS shown in FIG. 3.

The bilateral switch BS may take the form of a Quad Analog Switch/Quad Multiplexer, such as, a Motorola MOS MC14066B. As shown, the control terminals 5, 6, and 12 and the $V_{SS}$ terminal 7 are commonly connected to ground while the $V_{DD}$ terminal 14 is connected to the positive supply terminal +B. The in/out terminal 1 is connected to the other plate of the timing capacitor C3 while the out/in terminal 2 is connected to the $R_S$ terminal 3 of the speed oscillator SO.

The binary coded decimal counter BCDC may be a BCD up-down counter, such as, a Motorola MOS MC14510B, which includes type D flip-flop stages with gating structure to provide type T flip-flop capability. The counter BCDC can be cleared by applying a high level or binary "1" on RESET terminal 9 which is also connected to the start circuit. The start circuit includes a spring biased push-button starting switch SW which momentarily bridges point contacts PC and PC' when the button is depressed by a maintainer. As shown, the point contact PC is connected to front contact a of a zero velocity relay $V_O$. The relay $V_O$ controls a movable or heel contact b which is connected to a suitable source of positive d.c. supply potential, such as, voltage +V. The point contact PC' is connected to one end of the coil of departure test relay DIR while the other end of relay coil DTR is connected to ground. The relay DTR includes a stationary contact a' and a movable contact b' which shunt contacts a and b of zero velocity relay $V_O$ after initiation of a testing procedure by depression of switch SW. The point contact PC' is also connected to a voltage divider network including resistors R42 and R43. A by-pass capacitor C7 is connected in parallel with voltage divider resistor R42. It will be seen that the RESET terminal 4 of flip-flop FF and the RESET terminal 9 are connected to the joint point between resistors R42 and R43. The $V_{SS}$ terminal 8 and the terminals 1, 3, 13, 12, and 4 of the BCD counter BCDC are commonly connected to ground while the up-down terminal 10 and the $V_{DD}$ terminal 16 are connected to the positive supply terminal +B. It will be noted that the Q1, Q2, Q3, and Q4 terminals 6, 11, 12, and 2 of BCD counter BCDC are connected to the "D", "A", "B", and "C" terminals 11, 10, 13, and 12, respectively, of binary coded decimal-to-decimal decoded BCDD, such as, a Motorola MOS MC14028. Further, it will be observed that the Q1, Q2, and Q3 terminals 6, 11, and 12 of the BCD counter BCDC are also connected to the control terminals 9, 10, and 11 of the analog switches MD1 and MD2. In view of FIG. 1, it will be seen that the 3-bit code of output terminals 6, 11, and 14 of BCD counter BCDC is monitored by light emitting diodes LED 2, LED 3, and LED 4. As shown, an amplifier A3 is connected to light emitting diode LED 2 which, in turn, is connected to the positive voltage terminal +B via resistor R44. Similarly, an amplifier A4 is connected to light emitting diode LED 3 which, in turn, is connected to the positive supply terminal +B via resistor R45. Likewise, an amplifier A5 is connected to light emitting diode LED 4 which, in turn, is connected to the positive voltage terminal +B via resistor R46. Thus, the light emitting diodes will become illuminated whenever output terminals 6, 11, or 14 of BCD counter BCDC come high or assume a binary "1".

Figure 2:
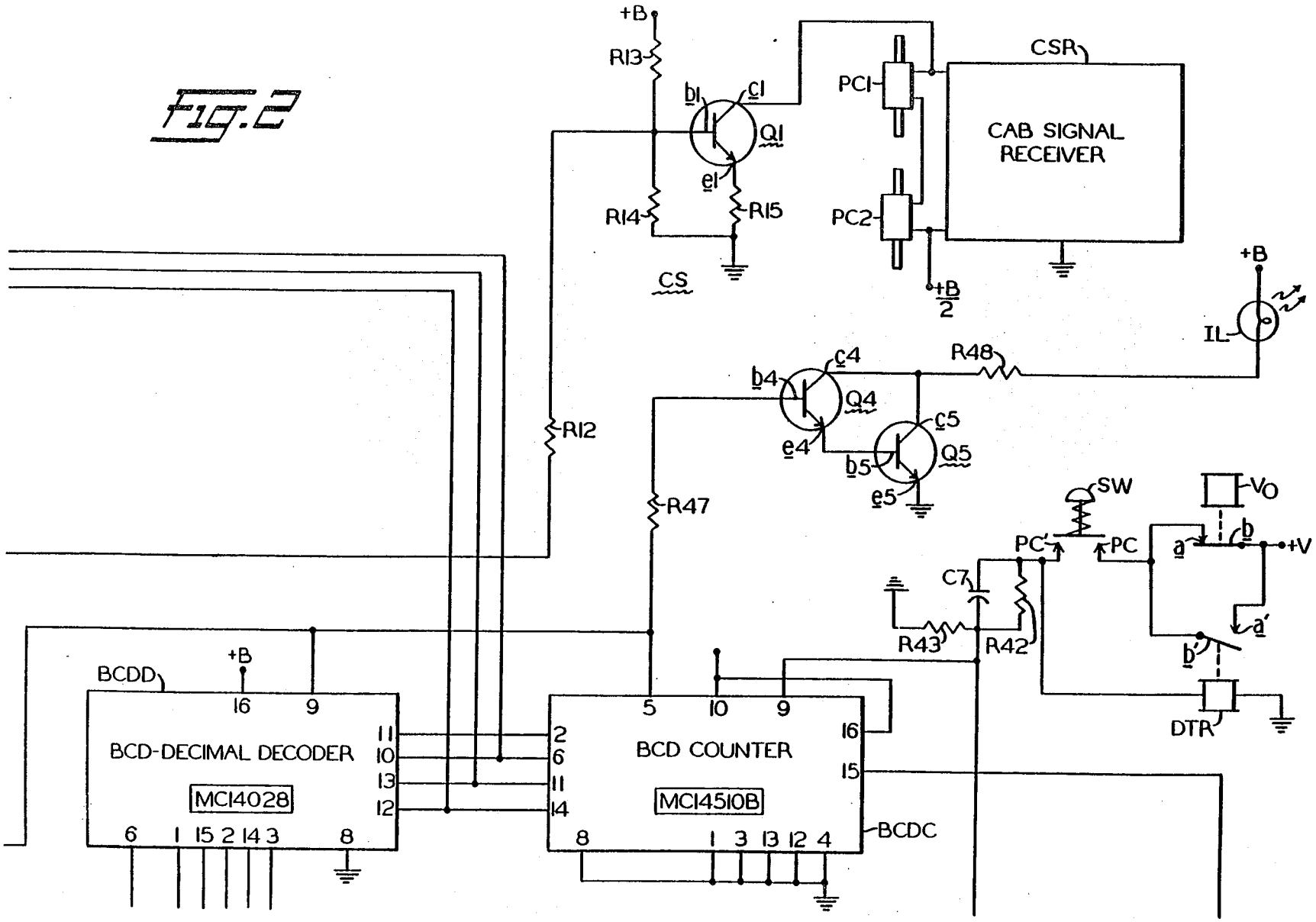

Turning now to FIGS. 2 and 4, it will be seen that the decimal decoder BCDD has its $V_{SS}$ terminal 8 directly connected to ground while its $V_{DD}$ terminal 16 is connected to the positive supply terminal +B. As shown, the QO output terminal 3 of decoder BCDD is connected to input terminal 1 of AND gate AG1 while the Q1 output terminal 14 is connected to the input terminal 5 of AND gate AG2. The Q2 output terminal 2 of decoder BCDD is connected to the input terminal 8 of AND gate AG3 while the Q3 output terminal 15 is connected to input terminal 12 of AND gate AG4. The Q4 output terminal 1 of decoder BCDD is connected to the input terminal 1 of AND gate AG5 while the Q5 output terminal 6 is connected to input terminal 5 of AND gate 6. It will be seen that the Q6 output terminal 9 of decoder BCDD is connected to a two-stage amplifier including a pair of NPN transistors Q4 and Q5. The transistor Q4 includes a base electrode b4, a collector electrode c4, and an emitter electrode e4 while the transistor Q5 includes a base electrode b5, a collector electrode c5, and an emitter electrode e5. As shown, the Q6 output terminal 9 of BCD decimal decoder BCDD is connected to the master RESET terminal 6 of the code oscillator COO of FIG. 1, and is also connected to the carry-in terminal 5 of the BCD counter BCDC. In addition, the Q6 output terminal of decoder BCDD is connected to the base electrode b4 of input transistor Q4 via resistor R47. The emitter electrode e4 is directly connected to the base electrode b5 of output transistor Q5 while the emitter electrode e5 is directly connected to ground. The collector electrodes c4 and c5 are commonly connected to one end of resistor R48. The other end of resistor R48 is connected to one end of the filament of an incandescent lamp IL while the other end of the lamp filament is connected to the positive voltage terminal +B. In practice, the incandescent lamp IL is mounted on the control console in the cab in the vehicle.

Now in describing the operation, let us assume that the automatic departure test unit is intact, that the circuitry is functioning properly, and that the maintainer desires to perform the daily departure test prior to releasing the train into revenue service. The car-borne departure test unit will only operate under the following conditions:

(a) the train is stopped and the zero velocity relay is energized,
(b) manual mode is established,
(c) the master controller is in a brake position, and
(d) the departure test push-button is depressed and held.

As previously mentioned, the built-in departure test unit in the cab of the vehicle will test cab signal speed command reception, overspeed, and zero velocity functions and will verify the proper operations by illuminating an end-of-test "GO" indication light which is mounted on the operator's console. When the master controller is in a brake position, the car-carried power supply furnishes operating voltage to the departure test unit. Since the train is stopped, the zero velocity relay $V_O$ is energized so that its contacts a and b are closed, and the manual mode contacts are in series with contacts a and b of relay $V_O$ once the test is initiated by the maintainer. That is, since simulated speeds or velocity will be generated by the test unit during the testing procedure, it is necessary to by-pass the zero velocity relay by a pair of shunting contacts a' and b' of departure test relay DTR. It will be seen that when the maintainer continuously depresses the start-to-test push-button switch SW, the BCD counter BCDC, and the FLIP-FLOP are reset by the positive voltage which is applied to terminals 9 and 4, respectively, from terminal +V via the R-C circuit including resistor R42 and capacitor C7. The RESET pulse causes or ensures that the $\overline{Q}$ output terminal goes or is high which is applied to the clock input terminal 15 of counter BCDC for starting the counter. The receipt of the input pulse causes the counter BCDC to roduce a binary "1", namely, a high signal, or a binary "0", namely, a low signal, on the respective output terminals 2, 6, 11, and 14. The binary code decimal signal is fed to the input terminals 11, 10, 13, and 12 of decoded BCDD which causes a high signal to be produced on its output terminal 3. The output terminals 6, 11, and 14 of counter BCDC are also fed to input control terminals 9, 10, and 11 of analog switches MD1 and MD2 as well as to the amplifiers A3, A4, and A5. In practice, the first clock pulse causes a binary "1" to appear on output terminal 6 of counter BCDC which causes amplifier A3 to illuminate light emitting diode LED 2 and which causes analog switches MD1 and MD2 to connect resistors R2 and R18 to the respective output terminals 3. Thus, the R-C time constant of resistor R2 and capacitor C1 causes the code oscillator COO to produce a code signal having a frequency of 5 Hz. The code signal on output terminal 8 drives the amplifier A1 so that the light emitting diode LED 1 is illuminated five (5) times a second and also modulates the 990 Hz carrier signal of oscillator CAO. The coded carrier signals developed on output terminal 13 are applied to the input of constant current transistor Q1. The impedances of the resistors R13 and R14 have been selected to cause an output current, which is equivalent approximately to 0.5 amperes of rail current to flow through the collector-emitter junction of transistors Q. Thus, the current signal which flows through the two series aiding pick-up coils PC1 and PC2 is equivalent to 0.5 amperes of actual rail current. The voltage developed across the pick-up coils is sufficient to drive the amplifier of the cab signal receiver CSR. It will be seen that if the receiver coils are misconnected or disconnected or if there are shorted turns on either pick-up coil, the receiver output will not be high enough to drive the decoder, and thus the faulty condition of the pick-up coils is verified. The amplified coded carrier signals are detected and decoded to cause a cab signal aspect to become illuminated which simulates and signifies an authorized speed command of 12 mph has been received.

The R-C time constant of resistor R18 and capacitors C3 and C4 causes the speed oscillator to produce a signal which corresponds to a speed hich is slightly less than the 12 mph speed limit. The signal is amplified by transistors Q2 and Q3 and is applied through the signal enhancing inductor L1 to the speed sensor. The coded carrier signal simultaneously causes the 12 mph relay to become energized. The 12 mph output signal is conveyed to the input terminal 2 of the AND gate AG1 via resistor R27. As previously mentioned, a high signal appears on terminal 3 of decoder BCDD and is applied to terminal 1 of AND gate AG1. The presence of both highs on terminals 1 and 2 causes a high on output terminal 3 which is applied to terminal 1 of OR gate OG1. The high outputs on terminal 9 of OR gate OG1 which is applied to input terminal 3 of OR gate OG2 for causing a high output on terminal 6 of OR gate OG2. The high output signal on terminal 6 is applied to one input terminal 12 of AND gate AG7. It will be appreciated that when the +B voltage is applied to the pulse generator TC, the astable oscillator produces periodic timing pulses on output terminal 3 which is inverted by amplifier A2. The inverted pulses are applied to the other input terminal 13 of the AND gate AG7. In practice, the generator TC produces pulses which have a frequency of 0.3 Hz and a duty cycle of approximately one percent (1%). Thus, the presence of the high signal on terminal 12 and the appearance of a positive pulse causes a high output on terminal 1 of AND gate AG7. The AND gate AG7 provides a clock pulse to terminal 3 of the flip-flop FF which causes $\overline{Q}$ output terminal 2 to go to low. The low signal on $\overline{Q}$ terminal 2 has no effect on the clock input 15 of counter BCDD but causes the bilateral switch BS to open the switch contacts connected to output terminals 1 and 2. The opening of the bilateral switch effectively removes the capacitor C4 from the R-C timing circuit of the speed oscillator so that the frequency of oscillation is slightly increased above the 12 mph level. At approximately the same time, the underspeed relay UR drops and closes its back contacts a–b due to the existing overspeed condition. The closing of the underspeed relay contacts causes the application of a positive voltage to the data input terminal 5 of flip-flop FF for causing the $\overline{Q}$ output terminal to go to a high level when the next pulse occurs from generator TC. The high signal is conveyed to clock terminal 15 of counter BCDC causing it to step to its next position and is also applied to bilateral switch BS to cause the closing of its switch contacts across output terminals 1 and 2. Thus, the timing capacitor C4 is again connected in parallel with timing capacitor C3. The stepping of the counter BCD causes the output of the decoder BCDD to change so that a high input is now applied to terminal 5 of AND gate AG2 from the decoder terminal 14. The binary code represents a decimal 2 so that output terminal 11 of the counter is high while output terminals 6 and 11 are at a low level. Thus, the amplifier A4 illuminates the light emitting diode LED 3 while the diode LED 2 is extinguished so that a maintainer may observe the diodes and determine that a binary code of 010 is displayed by the three diodes LED 2, LED 3, and LED 4. The high input binary "1" of terminal 10 of analog switch MD1 connects resistor R3 to output terminal 3 while the high input of terminal 10 of analog switch MD2 connects resistor R19 to output terminal 3. Thus, the frequency of the code signal produced by the code oscillator COO is increased so that the modulated carrier signal fed to the cab signal equipment initiates the next higher (20 mph) speed relay and indication on the operating console. The R-C time constant of resistor R19 and parallel capacitors C3–C4 causes the speed oscillator to produce a frequency which is effective in simulating a 20 mph output by the speed sensor. Further, as soon as the 20 mph speed signal is generated by speed oscillator SO, the underspeed relay UR is energized so that contacts a and b open and remove the +B voltage from the data terminal 5 of the flip-flop FF. The high signal appearing on the 20 mph terminal is conveyed to terminal 6 of AND gate AG2 via resistor R28. Accordingly, the presence of the inputs on terminals 5 and 6 of AND gate AG2 results in a high output on terminal 4 which is conveyed via OR gates OG1 and OG2 to the input terminal 12 of AND gate AG7. Now, when a timing pulse is delivered to input terminal 13 of AND gate AG7, a clock pulse is conveyed to terminal 3 of flip-flop FF hich causes the $\overline{Q}$ output terminal 2 to go to a low level. The low signal is conveyed to terminal 13 of the bilateral switch BS to cause the opening of the switch across terminals 1 and 2 so that timing capacitor C4 is again removed from input terminal 4 of the speed oscillator SO. The removal of capacitor C4 results in a decrease of the capacitance so that frequency of oscillation of oscillator SO is slightly increased above the 20 mph level. At about the same time, the underspeed relay UR is released due to the overspeed condition. The closing of contacts a and b of relay UR again results in the application of the positive voltage +B to the data input terminal 5 of flip-flop FF which causes the $\overline{Q}$ terminal 2 to assume a high condition. This high signal closes the bilateral switch BS and advances the BCD counter BCDC to its next step.

The sequence of operation of the departure testing unit continues in a similar manner for the 40 mph, 50 mph, and 60 mph with the output terminals 6, 11, and 14 going to binary digits of 110, 001, and 101. Let us now assume that the cab signal equipment has been checked for the 60 mph speed rate and that the underspeed relay UR has been deenergized by the overspeed condition of the speed oscillator SO. Under this condition, the positive voltage on data input terminal 5 of the flip-flop FF causes the $\overline{Q}$ output terminal 2 to go high so that the bilateral switch closes and reinserts timing capacitor C4 into the R-C circuit of speed oscillator SO. The high signal on terminal 2 of flip-flop FF also steps the counter BCDC to an 011 state, namely, terminal 6 is a binary "0" while terminals 11 and 14 are binary "1". The inputs to terminals 11, 10, 13, and 12 of decoder BCDD cause a high to be produced on output terminal 6 which is connected to the input terminal 5 of AND gate AG6. The high signals on output terminals 11 and 14 cause the illumination of the light emitting diodes LED 3 and LED 4. The inputs to terminals 9, 10, and 11 of analog switch MD1 cause the resistor R7 to be interconnected to output terminal 3 and input terminal 1 of the code oscillator COO so that a carrier signal is coded with a 16.8 Hz modulating signal. The coded carrier signal is again conveyed to the pick-up coils PC1 and PC2 via the constant current amplifier to check the integrity of the coils and to verify the proper operation of the receiver of the cab signal receiver CSR.

Similarly, the high signals on input terminals 10 and 11 of analog switch MD2 result in the resistor R23 being interconnected to output terminal 3 of analog switch MD2 and input terminal 2 of speed oscillator SO. The oscillator produces a speed signal which after amplification by transistors Q2 and Q3 is applied to the speed sensor and indicator relay circuit SS1R to produce an output on the 70 mph terminal. The 70 mph output signal is conveyed to terminal 6 of AND gate AG6 which along with the high on terminal 5 produces a high on output terminal 4 of AND gate AG6. The high is conveyed to input terminal 12 of AND gate AG7 via OR gates OG3 and OG2. Now when a time pulse is fed to input terminal 13 of AND gate AG7 by pulse generator TC, a high is developed on output terminal 1 of AND gate AG7 which is applied to the clock input terminal 3 of flip-flop FF. Thus, the output terminal 2 of flip-flop FF goes low and causes the opening of the bilateral switch BS which, in turn, removes capacitor C4 from the R-C timing circuit of the speed oscillator SO. This reduces the capacitance of the timing circuit and increases the frequency of oscillation to a value which is slightly greater than the 70 mph signal. Accordingly, the underspeed relay becomes deenergized so that contacts a and b close and apply a positive voltage to data input terminal 5 of flip-flop FF. Thus, the output terminal 2 of flip-flop FF goes high which closes the switch across terminals 1 and 2 of the bilateral switch BS and steps the counter BCDC to its next state which causes the decoder BCDD to produce a high on output terminal 9. The output terminal 9 of decoder BCDD is connected to master RESET terminal 6 of code oscillator COO, the carry-in terminal 5 of counter BCDD, and the base electrode b1 via resistor R47. Thus, the code oscillator COO is reset to ensure that the output terminal 8 is low so that there are no carrier signals developed on output terminal 13 of the oscillator CAO. The high carry-in signal resets the counter BCDC to its original initial condition. The high signal renders the transistors Q4 and Q5 conductive which causes the illumination of the incandescent lamp IL which signifies that the departure test is completed and that the train or vehicle may be taken and placed in revenue service. The test unit will remain in this end-of-test condition until the start button SW is pushed again or until power is removed from the supply terminals +B and +V to begin running operation of the train or transit vehicles.

It will be appreciated that if a signal fails to verify, the test unit will not proceed through the remainder of the test.

It will be understood that various alterations and changes may be made by those skilled in the art without departing from the spirit and scope of the subject invention. Therefore, it will be appreciated that all modifications, ramifications, and equivalents will be readily comprehended by persons skilled in the art, and thus, it is understood that the invention is not limited to the exact embodiment described herein but is to be accorded the full scope and protection of the appended claims.

Having now described the invention, what we claim as new and desire to secure by Letters Patent, is:

1. An automatic departure test unit for cab signal equipment comprising, first means for producing a plurality of coded carrier signals representing a series of speed commands, second means for producing a plurality of simulated speed signals, third means for causing said first means to produce one of said plurality of said coded carrier signals and for causing said second means to produce a corresponding one of said plurality of said simulated speed signals, fourth means for receiving said plurality of said coded carrier signals for checking the operability of a cab signal receiver, fifth means for checking the correspondence between said ones of said plurality of said coded carrier signals and said plurality of said simulated speed signals, and sixth means for verifying the functionality of overspeed operation by increasing said simulated speed signals to cause the release of an underspeed relay whereby each speed command of the series of said plurality of coded carrier signals and corresponding simulated speed signals is sequentially processed until the occurrence of a failure or until the completion of the test.

2. The automatic departure test unit as defined in claim 1, wherein said first means includes an integrated circuit code oscillator for producing a code rate which is controlled by varying the time constant of an R-C network.

3. The automatic departure test unit as defined in claim 2, wherein said third means includes an electronic switch which varies the resistance of the R-C network to control the code rate of said integrated circuit code oscillator.

4. The automatic departure test unit as defined in claim 2, wherein said first means includes an integrated circuit carrier oscillator which is modulated by the code rate of said integrated circuit code oscillator.

5. The automatic departure test unit as defined in claim 1, wherein said second means includes an integrated circuit speed oscillator for producing a simulated speed signal which is controlled by varying the time constant of an R-C network.

6. The automatic departure test unit as defined in claim 1, when said third means includes an electronic switch which varies the resistance of the R-C network to the frequency of oscillation of said integrated circuit speed oscillator.

7. The automatic departure test unit as defined in claim 1, wherein said fourth means includes a constant current amplifier having its output directly connected to the pick-up coils which are connected to the input of an amplifier of the cab signal receiver.

8. The automatic departure test unit as defined in claim 1, wherein said fifth means includes a logic network for providing the correspondence check.

9. The automatic departure test unit as defined in claim 1, wherein said sixth means includes a pulse generator and a bistable circuit which causes a bilateral switching circuit to increase said simulated speed signal.

10. The automatic departure test unit as defined in claim 9, wherein said sixth means includes a binary coded decimal counter which is conditioned by said astable multivibrator to cause the sequential processing of each speed command of the series of said plurality of coded carrier signals and corresponding simulated speed signals.

11. The automatic departure test unit as defined in claim 10, wherein said binary coded decimal counter controls the output state of a binary coded decimal-to decimal decoder.

12. The automatic departure test unit as defined in claim 11, wherein an output state of said binary coded decimal-to-decimal decoder causes an amplifier to illuminate an indicator light when the test is completed.

13. The automatic departure test unit as defined in claim 10, wherein said binary coded decimal counter causes the illumination of at least one of a plurality of lights which signifies the particular state of the sequential processing.

14. The automatic departure test unit as defined in claim 12, wherein the output state of said binary coded decimal-to-decimal decoder causes said binary coded decimal counter to assume a zero condition.

15. The automatic departure test unit as defined in claim 5, wherein the simulated speed signals produced by said integrated circuit speed oscillator are coupled by an amplifier to a speed sensor and indicator relay circuit.

16. The automatic departure test unit as defined in claim 2, wherein an amplifier causes an indicator light to flash in accordance with the code rate of said integrated circuit code oscillator.

17. An automatic cab signal testing apparatus for checking the integrity of the pick-up coils and the operation of the amplifier of the cab signal receiver and decoder units and for verifying the overspeed and zero velocity functions of the automatic train protection equipment comprising, a starting switch for initiating the testing operation only when the zero velocity relay is energized, said starting switch connected to the RESET terminals of a binary coded decimal counter and a FLIP-FLOP circuit, the output of said binary coded decimal counter is connected to the inputs of a pair of analog switches, one of said pair of analog switches interconnecting a selective value of resistance to the input of an R-C code oscillator, the output of said R-C code oscillator connected to the input of an R-C carrier oscillator for producing modulated carrier signals, the modulated carrier signals are fed to a constant current amplifier which is connected to the pick-up coils of the cab signal receiver, the other of said pair of analog switches interconnecting a selective value of resistance to the input of an R-C speed oscillator, the output of said R-C speed oscillator is connected by a multistage amplifier to the speed sensor, each of the output speed signals is connected to one input of a separate one of a plurality of two-input AND gates, the outputs of the plurality of said two-input AND gates are coupled by a plurality of OR gates to one input of another two-input AND gate, a pulse generator is connected to the other input of said another two-input AND gate the output of said another two-input AND gate is connected to the clock input of said flip-flop circuit, an underspeed relay contact is connected to the data input to said flip-flop circuit the output of said flip-flop circuit is connected to the input of a bilateral switch which has its output selectively connected to the input of said R-C speed oscillator, the output of said flip-flop circuit is also connected to the clock input of said binary coded decimal counter, the output of said binary coded decimal counter is connected to the input of a binary coded decimal-to-decimal decoder which produces a given one of a plurality of output signals, all but one of said plurality of output signals of said binary coded decimal-to-decimal decoder are connected to the other input of said separate ones of said plurality of said two-input AND gates, and said one of said plurality of input signals of said binary coded decimal-to-decimal decoder is connected by an amplifier to an end-of-test indicating means.

* * * * *